United States Patent [19]

Schoenberg

[11] 4,383,030

[45] May 10, 1983

[54] LOW COATING WEIGHT SILVER HALIDE ELEMENT USING MIX SENSITIZATION TECHNIQUES

[75] Inventor: Allan R. Schoenberg, Asheville, N.C.

[73] Assignee: E. I. Du Pont de Nemours and Company, Wilmington, Del.

[21] Appl. No.: 257,972

[22] Filed: Apr. 27, 1981

[51] Int. Cl.[3] ..... G03C 1/28

[52] U.S. Cl. ..... 430/599; 430/603; 430/569; 430/605; 430/621

[58] Field of Search ..... 430/603, 599, 569, 605, 430/621

[56] References Cited

U.S. PATENT DOCUMENTS

| | | | |
|---|---|---|---|
| 3,232,764 | 2/1966 | Allen et al. | 96/111 |
| 3,294,536 | 12/1966 | Baden et al. | 430/451 |
| 4,124,397 | 11/1978 | Abele et al. | 96/109 |
| 4,175,970 | 11/1979 | LeStrange | 430/529 |
| 4,294,920 | 10/1981 | Helling et al. | 430/569 |

*Primary Examiner*—Won H. Louie, Jr.

[57] ABSTRACT

The sensitivity of a gelatino-silver halide emulsion is improved by adding glutaraldehyde bisulfite in combination with benzene sulfinic acid during the preparation of the silver halide, viz. when a silver salt is mixed with a halide to precipitate a silver halide.

8 Claims, 1 Drawing Figure

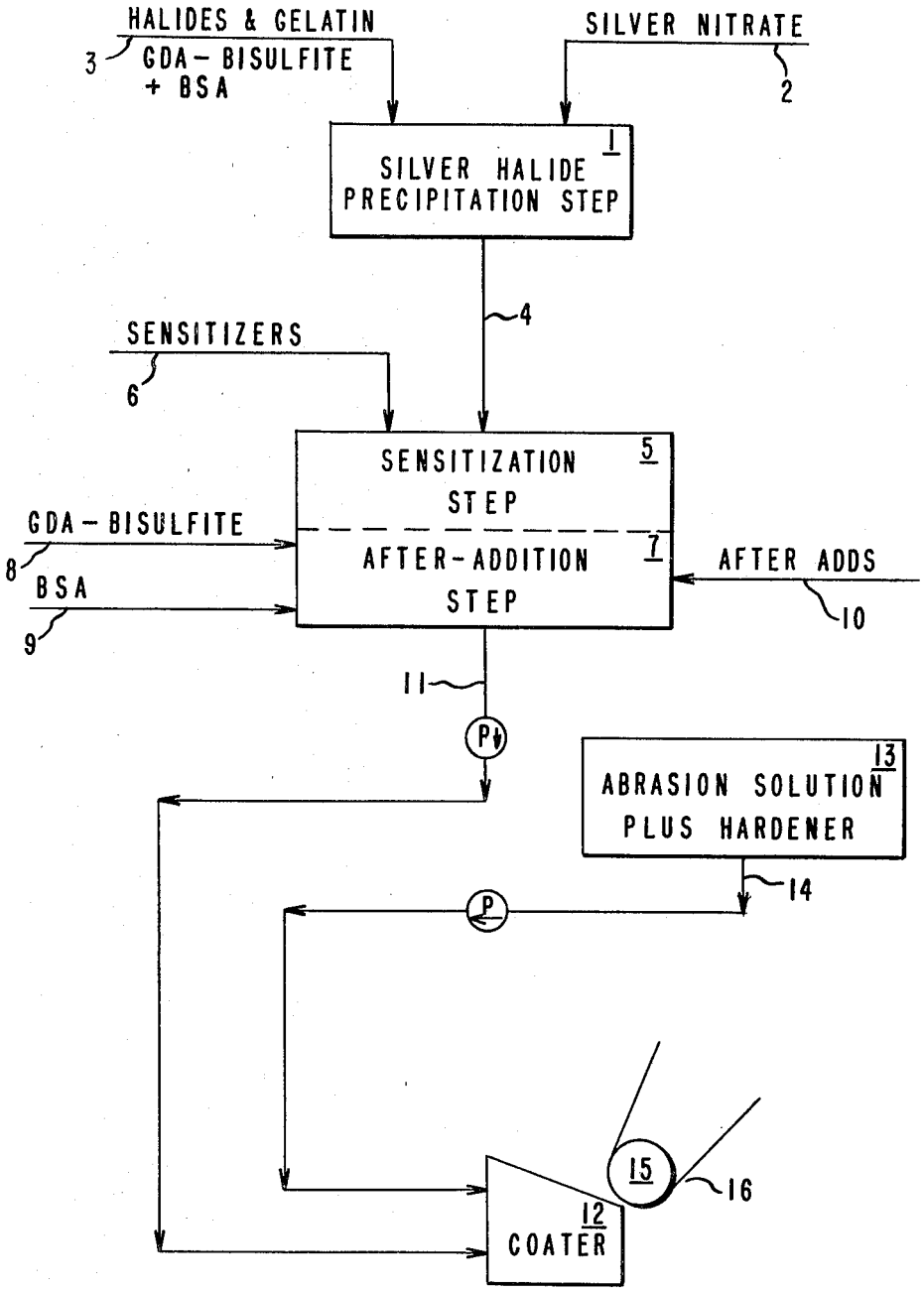
HALIDES & GELATIN
3
GDA-BISULFITE
+ BSA
SILVER NITRATE
2
SILVER HALIDE
PRECIPITATION STEP
1
4
SENSITIZERS
6
SENSITIZATION
STEP
5
GDA-BISULFITE
8
AFTER-ADDITION
STEP
7
AFTER ADDS
10
BSA
9
11
P
ABRASION SOLUTION
PLUS HARDENER
13
14
P
15
16
COATER
12

LOW COATING WEIGHT SILVER HALIDE ELEMENT USING MIX SENSITIZATION TECHNIQUES

DESCRIPTION

Technical Field

This invention is in the field of photographic film, and more particularly in an improved process for sensitizing photographic gelatino-silver halide emulsions.

Background Art

It is known that dialdehydes are effective hardeners for photographic gelatino-silver halide emulsions. U.S. Pat. No. 3,232,764 and U.S. Pat. No. Re. 26,601 disclose dialdehydes, the aldehyde groups of which are separated by an unbranched chain of 2–3 carbon atoms, preferably glutaraldehyde and its derivatives, to be useful for just such a purpose. Those derivatives include the alkali-metal bisulfite addition product, hereinafter the bisulfite. These patents state that it is necessary to add the dialdehyde, or its bisulfite, in a concentration of at least 0.5 to 25% by weight of the gelatin content of the emulsion.

Abele et al, U.S. Pat. No. 4,124,397, describes a process for hardening photographic silver halide emulsions, which uses the hardening effects of glutaraldehyde, or substituted glutaraldehyde, in combination with an aliphatic or aromatic sulfinic acid or salt thereof. In the Abele et al process the glutaraldehyde hardener is added in a concentration of less than 0.5% by weight, based on the gelatin content of the emulsion; and a combination of good hardening effects and improved sensitometry is achieved by adding the hardener "in-line" in a continuous manner and just prior to the coating step. The Abele et al process, however, requires the use of special equipment which is complicated and difficult to maintain. When faults occur during the operation, the addition of the hardener is interrupted. This interruption cannot be easily detected and many square feet of film may be coated without hardener before the interruption is subsequently detected.

LeStrange, U.S. Pat. No. 4,175,970 discloses a process for sensitizing photographic silver halide emulsion, characterized by the addition thereto of small amounts (e.g., 0.1 to 0.3% by weight, based on gelatin content) of glutaraldehyde (GDA) bisulfite or substituted glutaraldehyde bisulfite in combination with a sulfinic acid or salt thereof (e.g., sodium benzene sulfinate or toluene sulfinate) at a concentration below the hardening level. This combination is added to the gelatino-silver halide emulsion after the normal sensitization (e.g., with gold and sulfur) has occurred and prior to coating the emulsion on a support. Its effect is to significantly increase the sensitivity of the emulsion with little or no increase in fog. LeStrange conventionally adds his ingredients along with the coating aids, antifoggants, etc. There is a pressing need, however, to further increase the sensitivity of photographic film in order to achieve a reduction in silver halide coating weights in an effort to reduce costs and to conserve scarce raw materials.

BRIEF DESCRIPTION OF THE DRAWING

The sole FIGURE of drawing is a flow sheet illustrating the process of this invention.

DISCLOSURE OF THE INVENTION

The present invention is directed to a process for preparing a photosensitive gelatino-silver halide emulsion, characterized in that a dialdehyde bisulfite, preferably glutaraldehyde (GDA) bisulfite or a substituted GDA bisulfite, are added thereto in concentrations of 0.016% to 1.6% by weight based on the weight of the silver halide, in combination with an aromatic sulfinic acid, e.g., benzene sulfinic acid or toluene sulfinic acid, or a water-soluble salt thereof, in concentration of 0.018 to 1.8% by weight, based on the weight of silver halide, at the silver halide precipitation stage, i.e., the stage when silver nitrate is mixed with the desired halide(s) in the presence of gelatin to precipitate a silver halide. This process, labelled "mix-sensitization", significantly increases the sensitivity of the emulsion with little or no fog increase. At these concentrations no significant hardening of the gelatin occurs nor is there a detectable shift in grain size. The effect of increased sensitization by use of the above mix-sensitization procedure is over and above the improved speed/fog effect obtained by use of GDA plus sulfinic acid as "after-adds" as per LeStrange, U.S. Pat. No. 4,175,970, supra.

To sensitize the emulsion even further, this mix-sensitization process can be extended by addition of the same ingredients, in the same concentration, as specified in the LeStrange patent supra, later on the emulsion-making process.

Photographic films made from the emulsions prepared by following the process of this invention have superior speed over products which do not utilize the mix-sensitization process of this invention, with sensitometric effects being equivalent. This increase in speed permits films to be prepared with lower silver coating weights (ca. 10%) and improved internal sensitivity. In addition, such photographic film will have equal fog stability on aging as indicated by over-development fog results, and have an equivalent susceptibility to kink densensitization, compared to products which do not use the mix-sensitization process of this invention. These last two properties are particularly useful in X-ray film.

Bisulfites of the following dialdehydes are suitable for use in practising this invention:

glutaraldehyde
2-methyl glutaraldehyde
3-methyl glutaraldehyde
2,2'-dimethyl glutaraldehyde
2-N-butoxy-glutaraldehyde
3-N-butoxy-glutaraldehyde
2-methyl-3-ethoxy-glutaraldehyde
2-ethyl-3-ethoxy-glutaraldehyde Referring now to the drawing, the silver halide precipitation step 1—also referred to as the mix step—is conducted in conventional manner in a kettle or other receptacle into which aqueous silver nitrate is metered through line 2, and an aqueous gelatino-halide solution through line 3. Preferably, GDA-bisulfite and benzene sulfinic acid (BSA) are added along with this halide solution in line 3. The precipitated gelatino-silver halides, now mix-sensitized with GDA-bisulfite and the sulfinic acid (BSA), are washed in known manner and are passed through line 4 into a vessel (kettle) represented by 5, 7 in the drawing. Conventional sensitizers (e.g., gold, sulfur, mercury, etc.) are added through line 6, along with more water and gelatin, if needed, and the emulsion is digested at elevated temperatures to achieve increased sensitivity, as well-known to those skilled in the art. This is labelled sensitization step 5 on the drawing.

After the emulsion is thus sensitized, numerous conventional after-additions are added from line 10, along with some more GDA-bisulfite and sulfinic acid, lines 8 and 9, such after-additions being added into the same receptacle as that in which the sensitization takes place. In this drawing, the overall addition of GDA-bisulfite, BSA, and "after-adds" is collectively labelled "after addition step" 7. The conventional after-additions include wetting agents and antifoggants, as well as adjuvants to adjust for pH and the like. The fully sensitized emulsion is pumped through 11 to a coating station, labelled "coater" 12 on the drawing.

In a separate vessel 13 a gelatin abrasion solution containing hardener is made up and pumped through line 14 to coating station 12. At this point in the process the silver halide emulsion is coated upon a running length or web of support film 16 running over roller 15, and the abrasion layer is then applied over the silver halide layer. It is conventional to harden X-ray gelatino-silver halide elements in this manner since the hardener migrates from the abrasion layer to the silver halide layer. When coating other black and white gelatino-silver halide photographic elements it is conventional to add the hardening agent directly to the emulsion formulation just prior to coating (e.g., as an after-addition adjuvant or by in-line injection into line 11, for example).

The photographic layers and other layers associated therewith can be coated on a wide variety of supports including cellulose nitrate, poly(ethylene terephthalate), and polycarbonate films; also glass, metal, paper and the like. The layers may be coated in multiple coatings on one or both sides of the support. Auxiliary subbing layers may be coated on the supports to improve adhesion of the emulsion thereto. In a preferred embodiment a layer of the emulsion is coated on both sides of a biaxially oriented and subcoated poly(ethylene terephthalate) film support.

In place of glutaraldehyde, bisulfite or substituted glutaraldehyde bisulfite it is possible to use succinaldehyde bisulfite. Aromatic sulfinic acids useful in this invention include benzene or toluene sulfinic acid or analogs thereof, including the alkali metal salts. It is preferred to use glutaraldehyde bisulfite and sodium benzene sulfinate, added 2–4 minutes prior to the addition of the first silver nitrate solution. During the mixing procedure (when the silver halide grains are formed) it is customary to divide the silver nitrate solution and add separate amounts to a constant flow of halides and gelatin solution following so-called "splash" procedures. Thus, the silver nitrate is added rapidly, "splashing" into the halides and gelatin, and several "splashes" can be added. It is preferred to add the sensitizers shortly before this first splash. Other methods of silver halide manufacture such as the twin-stream mixing techniques can also be used in the practice of this invention with good results. The dialdehyde bisulfite and the aromatic sulfinic acid, the adjuvants of this invention, can be added at any point during the manufacture of the silver halide grains with any of the solutions used. Preferably, however, they are added as shown in the drawing.

The process of this invention is suitable for sensitizing all of the usual light sensitive gelatino-silver halide emulsions including silver bromide, silver chloride, silver chlorobromide, silver bromoiodide, etc. As pointed out above in connection with line 10 of the drawing, the emulsion can contain all the usual, common adjuvants such as coating and wetting aids, antifoggants, optical sensitizers and the like. The "hardener" in element 13 of the drawing may be glyoxal, formaldehyde, mucochloric acid, or chrome alum, among others.

The sensitization effects noted in the practice of this invention are effective in combination with most other sensitization techniques and produce additive results. Thus, an emulsion that has been optimally sensitized with sulfur and gold and with a dialdehyde bisulfite and a sulfinic acid as taught by LeStrange, U.S. Pat. No. 4,175,970 can be further sensitized by sensitization with additional amounts of dialdehyde bisulfite and sulfinic acid as taught herein. It is thus possible to raise the sensitivity of emulsions produced by this invention such that lower silver halide coating weights can be achieved on photographic film produced therefrom.

This process is illustrated by the following Examples of which Example 1 constitutes the best mode:

EXAMPLE 1

The following procedure was used to prepare silver halide grain for use in this example from the following solution:

| | | | |
|---|---|---|---|
| A. | Distilled water | 950 cc | |
| | $NH_4Br$ (solid) | 310 g | |
| | 0.5N KI | 120 cc | |
| | Gelatin | 40 g | |
| | | | :added 2–4 |
| | | | :minutes |
| | Glutaraldehyde bisulfite | 7.0 cc | :before |
| | (10% aq. soln.) | | :first |
| | | | :silver |
| | Sodium benzene sulfinate | 7.0 g | :addition |
| B. | Distilled water | 1020 cc | |
| | Silver nitrate soln. (3N) | 320 cc | |
| | .0375N $TlNO_3$ | 5.4 cc | |
| | 13N $NH_4OH$ | 191 cc | |
| C. | Distilled water | 373 cc | |
| | Silver nitrate soln. (3N) | 680 cc | |
| | .0375N $TlNO_3$ | 4.4 cc | |
| D. | Glacial acetic acid | 125 cc | |
| E. | Water | 3200 cc | |
| | Elvanol-71 (PVA, 12% solids)[1] | 50 cc | |
| | Mix temperature - 110° F. | | |
| F. | Water | 2000 cc | |
| | 98% $H_2SO_4$ | 62 cc | |
| G. | Water | 8000 cc | |
| | Elvanol-71 (PVA, 2.5% solids)[1] | 2.0 cc | |
| | 1.5N $H_2SO_4$ | 5.0 cc | |
| H. | Same as G | | |

[1]Available from E. I. du Pont de Nemours and Company.

B was added to A while stirring, and 4 min. later C was added to A. D was then added 8 min. later. E was then added, and the gelatino-silver bromoiodide grains were allowed to settle. The supernatant liquid was decanted and the grains washed by stirring with F, decanted, stirred with G, decanted and finally stirred with H, followed by decanting.

The grains prepared as described above were coarse-grained and contained ca. 98 mole % AgBr and ca. 2 mole % AgI. They were then further dispersed in gelatin and water to give a total gelatin content of ca. 5% and a total silver halide content of ca. 10% in water. The emulsion was then sensitized with gold and sulfur as described in Example 1 of LeStrange, U.S. Pat. No.

4,175,970. After sensitization, the usual coating and wetting agents and antifoggants were added as well as GDA-bisulfite (ca. 0.08% or gelatin) and sodium benzene sulfinate (ca. 2% on silver halide) and the emulsion coated on subbed poly(ethylene terephthalate) film to a thickness of about 60 mg/dm$^2$ of silver bromide. A 10 mg/dm$^2$ abrasion layer of gelatin containing formaldehyde hardener was applied on top of the silver halide layer. For control purposes, films were prepared from emulsion identical to that described above but without the GDA-bisulfite and sodium benzene sulfinate added during grain preparation.

Sample strips of these dried coatings (35 mm) were placed back-to-back (to simulate double-side coated material) in an X-ray cassette along with a pair of calcium tungstate X-ray screens so that the emulsion sides faced the X-ray screens. These samples were exposed and processed as described in LeStrange, U.S. Pat. No. 4,175,970, Example 1, using the procedures and the developer solution contained therein. The following results were achieved:

| SAMPLE | RELATIVE SPEED | BASE + FOG | DESENSITIZATION[1] KINK |
|---|---|---|---|
| Control | 100 | 0.23 | .11 |
| Of the Invention | 110 | 0.24 | .10 |

[1]Density loss when a 33 mm strip is bent around a ⅜ inch diameter metal bar, exposed and developed as above, and compared to an unkinked sample at a net density of 1.0.

EXAMPLE 2

Following the procedures outlined in Example 1, four separate mixes of silver halide grains were prepared with identical additions except as indicated below:

| Mix | Additions | |
|---|---|---|
| | GDA.HSO$_3$ (10% Aq. Soln.) | Sodium Benzene Sulfinate |
| A-Control | None | None |
| B | 6.0 cc | 4.0 g |
| C | 6.0 cc | None |
| D | None | 4.0 g |

The mixes were then further sensitized and coated as described in Example 1. Sample strips were exposed and developed and the sensitometry measured as follows:

| Mix | Rel. Speed | Base + Fog | Over-Development[2] Fog |
|---|---|---|---|
| A-Control (nothing added at mix) | 100 | .30 | .65 |
| B-(GDA.HSO$_3$ + sodium benzene sulfinate) | 109 | .19 | .24 |
| C-(GDA.HSO$_3$ alone) | 96 | .28 | .59 |
| D-(Sodium benzene sulfinate) | 63 | .14 | .17 |

[2]After one week in a tropical oven (120° F. and 65% RH).

This example demonstrates that it is necessary to have both ingredients added at mix in order to achieve both increased speed and fog stability.

EXAMPLE 3

Example 1 was repeated except that 0.625 g (1.95 mmole) of β-methyl-glutaraldehyde bisulfite per 1.5 mole silver halide was substituted for GDA.HSO3. An improvement of 10% in speed with low fog was noted in films prepared from this emulsion in comparison to a control in which the adjuvants of this invention were not added during grain preparation.

EXAMPLE 4

Example 1 was repeated, substituting 5.22 g of the sodium salt of p-toluene sulfinic acid for the sodium benzene sulfinic acid. Films prepared from this emulsion had a ca. 20% increase in speed, and fog levels comparable to controls which did not contain the adjuvants of this invention.

Mix sensitization per se is disclosed in the prior art, using, for example ammonium or sodium thiosulfate. However, this has not been practiced commercially because the powerful sensitization action of these compounds makes the process too difficult to control. These methods require a great deal of care in use so as not to increase the fog of the film element prepared therefrom. The instant invention avoids this result. Thus, the preceding Examples demonstrate that the combination of GDA-bisulfite and aromatic sulfinate produces high emulsion sensitivity, e.g., speed, without a concurrent increase in fog.

The drawing should be considered as illustrative only, since the adjuvants of this invention can be added in any of the various solutions used to precipitate the silver halide grains and at any time during this process with equivalent results.

I claim:

1. A process for preparing a photosensitive gelatino-silver halide emulsion, characterized in that glutaraldehyde (GDA) bisulfite or substituted GDA-bisulfite are added thereto in concentrations of 0.016–1.6% by weight based on the weight of the silver halide, in combination with an aromatic sulfinic acid or a water-soluble salt thereof, at the silver halide precipitation stage.

2. The process of claim 1 wherein the process is extended by addition of the same ingredients after the chemical sensitization stage of the emulsion-making process.

3. The process of claim 1 wherein the aromatic sulfinic acid is benzene sulfinic acid or toluene sulfinic acid at a concentration of 0.018–1.8% by weight, based on the weight of silver halide.

4. The process of claim 1 wherein the aromatic sulfinic acid is added in the form of an alkali metal salt.

5. The process of claim 1 wherein a layer of the gelatino-silver halide emulsion is coated on both sides of a biaxially oriented and subcoated poly(ethylene terephthalate) film support.

6. A process for the sensitization of a light-sensitive gelatino-silver halide emulsion prior to coating it upon a support, in which process the gelatino-silver halide emulsion is made up in a silver halide precipitation step by mixing silver nitrate with an alkali metal halide in the presence of gelatin, and is subsequently introduced into a coater for application to a film support, characterized in that the emulsion is mix-sensitized by adding thereto in the silver halide precipitation stage (1) either glutaraldehyde bisulfite, succinaldehyde bisulfite, or a substituted glutaraldehyde bisulfite, in a concentration of 0.016–1.6% by weight, based on the weight of silver halide in the emulsion, and (2) an aromatic sulfinic acid, or a water-soluble salt thereof, in a concentration of 0.018 to 1.8% by weight, based on the weight of silver halide in the emulsion.

7. The process of claim 6 wherein the gelatino-silver halide emulsion is further sensitized by repeating the addition of additives (1) and (2) after the chemical sensitization stage of the emulsion-making process.

8. A process for the sensitization of a light-sensitive gelatino-silver halide emulsion prior to coating it upon a support, in which process the gelatino-silver halide emulsion is made up in a silver halide precipitation step by mixing silver nitrate with an alkali metal halide in the presence of gelatin, and is subsequently introduced into a coater for application to a film support, characterized in that the emulsion is mix-sensitized by adding thereto in the silver halide precipitation stage (1) either glutaraldehyde bisulfite, succinaldehyde bisulfite, or a substituted glutaraldehyde bisulfite, in a concentration of 0.016–1.6% by weight, based on the weight of silver halide in the emulsion, and (2) an aromatic sulfinic acid, or a water-soluble salt thereof, in a concentration of 0.018 to 1.8% by weight, based on the weight of silver halide in the emulsion, and further characterized in that the process comprises the further steps of washing the precipitated and sensitized light-sensitive gelatino-silver halide emulsion, adding to the emulsion: (1) a gold or sulfur sensitizer, followed by a digestion step, (2) glutaraldehyde bisulfite and the sodium salt of benzene sulfinic acid in the range of concentration set forth above;

pumping the resulting sensitized emulsion to a coating station; preparing in a separate vessel a solution of gelatin and formaldehyde hardener, and pumping said solution to the coating station; applying from the latter a continuous layer of the sensitized gelatino-silver halide emulsion to a support film;

and then applying over the silver halide emulsion layer as an abrasion layer said gelatin solution containing formaldehyde hardener.

* * * * *